US010099810B2

(12) United States Patent
Langemaat

(10) Patent No.: US 10,099,810 B2
(45) Date of Patent: Oct. 16, 2018

(54) DEVICE FOR EXTRACTING PILLS FROM A BLISTER AND METHOD FOR ADJUSTING THE DEVICE

(71) Applicant: Willem Langemaat, Emmen (NL)

(72) Inventor: Willem Langemaat, Emmen (NL)

( * ) Notice: Subject to any disclaimer, the term of this patent is extended or adjusted under 35 U.S.C. 154(b) by 220 days.

(21) Appl. No.: 14/896,240

(22) PCT Filed: Jun. 17, 2014

(86) PCT No.: PCT/NL2014/050397
§ 371 (c)(1),
(2) Date: Dec. 4, 2015

(87) PCT Pub. No.: WO2014/204305
PCT Pub. Date: Dec. 24, 2014

(65) Prior Publication Data

US 2016/0137329 A1 May 19, 2016

(30) Foreign Application Priority Data

Jun. 17, 2013 (NL) ..... 2010987

(51) Int. Cl.
*B65B 69/00* (2006.01)
*A61J 1/03* (2006.01)

(52) U.S. Cl.
CPC ..... *B65B 69/0058* (2013.01); *A61J 1/035* (2013.01)

(58) Field of Classification Search
CPC .. B65B 69/0058; B65B 69/0041; A61J 1/035; A61J 7/0076; B65D 83/0463; G07F 17/0092
See application file for complete search history.

(56) References Cited

U.S. PATENT DOCUMENTS 2,587,289 A * 2/1952 Cook ..... A01D 45/24 209/326
2,589,440 A * 3/1952 Sharpe ..... A01F 7/04 460/100

(Continued)

FOREIGN PATENT DOCUMENTS

CN 101687558 A 3/2010
DE 29907976 U1 9/1999

(Continued)

OTHER PUBLICATIONS

Dutch search report in priority application NL 2010987, dated Jan. 22, 2014.

(Continued)

*Primary Examiner* — Glenn F Myers
(74) *Attorney, Agent, or Firm* — Oppedahl Patent Law Firm LLC

(57) ABSTRACT

The invention relates to a device for extracting pills from a blister pack provided with a push-through foil, comprising:

an at least partially curved extracting surface for stationary placing of the blister pack, wherein the push-through foil lies against the extracting surface and wherein the extracting surface is provided on the underside with drop openings corresponding to positions of the pills in the blister pack, one or more rotatable pressure rollers, wherein each pressure roller is rollable with predetermined rolling pressure over at least a part of the surface of the blister pack during operation for the purpose of pressing the pills out of the blister pack through the push-through foil and through the drop openings, and a collecting means placed under the extracting surface for collecting pills which have dropped through the drop openings.

19 Claims, 7 Drawing Sheets

(56) References Cited

U.S. PATENT DOCUMENTS

| | | | | | |
|---|---|---|---|---|---|
| 5,038,968 | A * | 8/1991 | Albetski | B65B 69/0058 | 206/531 |
| 5,368,187 | A * | 11/1994 | Poncetta | B65B 69/0058 | 206/531 |
| 6,024,247 | A | 2/2000 | Birr | | |
| 6,474,500 | B1 * | 11/2002 | Carr | A01C 7/04 | 221/25 |
| 2008/0257904 | A1 | 10/2008 | Schiff | | |
| 2014/0241838 | A1 * | 8/2014 | Beck | B65B 69/0058 | 414/412 |

FOREIGN PATENT DOCUMENTS

| | | | |
|---|---|---|---|
| GB | 2328922 | B | 2/2002 |
| JP | 2004131149 | A | 4/2004 |
| JP | 2010006382 | A | 1/2010 |
| JP | 2013028406 | A | 2/2013 |
| WO | 2011023941 | A2 | 3/2011 |
| WO | 2013072579 | A | 5/2013 |

OTHER PUBLICATIONS

International search report in international application No. PCT/NL2014/050397, dated Sep. 24, 2014.

* cited by examiner

DEVICE FOR EXTRACTING PILLS FROM A BLISTER AND METHOD FOR ADJUSTING THE DEVICE

The invention relates to a device for extracting pills from a blister pack provided with a push-through foil, comprising:

an at least partially curved extracting surface for stationary placing of the blister pack, wherein the push-through foil lies against the extracting surface and wherein the extracting surface is provided on the underside with drop openings corresponding to positions of the pills in the blister pack, one or more rotatable pressure rollers, wherein each pressure roller is rollable with predetermined rolling pressure over at least a part of the surface of the blister pack during operation for the purpose of pressing the pills out of the blister pack through the push-through foil and through the drop openings, and a collecting means placed under the extracting surface for collecting pills which have dropped through the drop openings.

The device according to the preamble is known in the field and is described in the international patent application WO 2013/072579. The device is referred to in technical terms as a deblistering machine.

The known device has a number of drawbacks.

The drawback of the known device is that in the known device the push-through foil of the blister pack is not tensioned during pushing-through of the pills, whereby it occurs that one or more pills remain behind in the blister pack. Tensioning of the foil is for that matter an operation which a person often also performs when pressing a pill manually out of the blister pack.

In addition, the known device has the drawback that, due to the form of the extracting surface, the blister pack is placed unstably in the device so that automatic feed of the blister packs is difficult. It is hereby difficult or impossible to automate the known device.

The known device moreover has the drawback that not all pills pressed out of the blister pack drop directly into the collecting means but onto or alongside components of the known device. These are components which are difficult to access, whereby these components cannot be cleaned effectively. The pills can as a result become contaminated with substances from previous blister packs.

It is the object of the invention to provide a device according to the preamble which wholly or largely obviates the above drawbacks. The device according to the invention has for this purpose the feature that the at least partially curved extracting surface takes a concave form. This measure ensures that the push-through foil is tensioned when the pills are pressed out, whereby the pills no longer remain behind in the blister pack. As a result of the measure taken the blister pack moreover remains lying in stable manner in the device.

In an embodiment of the device according to the invention which is highly suitable for automation the one or more pressure rollers are arranged for rotation around a rotation shaft, wherein the longitudinal direction of each pressure roller runs parallel to the rotation shaft and the rotation shaft is arranged substantially above the extracting surface. In contrast to the known device, the pressure roller is no longer limited to a reciprocating movement but can also make a rotating movement, whereby there are more possibilities for automating the device according to the invention.

The extracting surface preferably takes an at least partially cylindrical form and the rotation shaft coincides with the axis of the cylindrically formed part of the extracting surface. Owing to these measures the pressure rollers will roll more easily over the extracting surface, wherein the pressure exerted by the pressure roller is substantially the same over all parts of the blister pack.

The rolling pressure of at least one pressure roller is preferably adjustable. It is however most recommended to make the rolling pressure of all pressure rollers adjustable.

In a first embodiment of the device according to the invention the pressure rollers are disposed in pairs such that during operation each pair of pressure rollers rolls over a blister pack. Pressing out of the pills can hereby be performed in two steps, wherein the first pressure roller of the pair of pressure rollers breaks the push-through foil, preferably at a high rolling pressure, and the second pressure roller of the pair of pressure rollers presses the pills out of the blister pack. It is of course also possible here that the first pressure roller of the pair of pressure rollers will have pressed pills out of the blister pack.

The device according to the invention is preferably provided with one or more sweeping means which are each arranged rotatably around the rotation shaft such that during operation one of the sweeping means sweeps over at least a part of the extracting surface after the pills have been pressed out of a placed blister pack by the one or more pressure rollers. With these measures an empty blister pack will be automatically removed from the extracting surface by the sweeping means. Once the pills have been pressed out of a blister pack the device is hereby ready for the following blister pack, and the blister pack does not first have to be removed manually.

The extracting surface is preferably provided with a stop member for holding the blister pack in position during rolling of one of the pressure rollers over the blister pack during operation.

In an alternative embodiment of the device according to the invention the device is provided with one or more brushes and means for rotating the brushes, wherein the one or more brushes are arranged rotatably around the rotation shaft and the longitudinal direction of each brush runs parallel to the rotation shaft and wherein the brushes brush over at least a part of the blister pack during operation. The device is preferably provided with motors for rotating the brushes. The technical effect of these measures is that the blister pack is set into vibration, whereby the pills present in the blister pack are vibrated out of the blister pack.

In the preferred embodiment of the device the device is preferably further provided with a series of substantially flat partitions which run parallel, wherein at least a portion of an upper side thereof forms the extracting surface, wherein the mutual distance between the partitions is adjustable, the drop openings are formed by one or more spaces between the partitions and the partitions are arranged such that the pills pressed through the blister pack can drop without interruption via the drop openings into the collecting means. Using the flat partitions an extracting surface is created on the upper side thereof which can be adapted to the type of blister pack. It is important here that the pills can drop unimpeded into the collecting means without being obstructed by components for arranging the partitions in the device.

The preferred embodiment of the device is for this purpose preferably further provided with at least two first guides which run parallel and which each lie substantially transversely of the partitions and which are intended for the purpose of supporting the partitions and adjusting the mutual distance between the partitions. The first guides are mounted here such that the pills are not obstructed by the first guides when dropping into the collecting means.

In order to adjust the mutual distance between the partitions each first guide is preferably provided with a series of first grooves into which a partition can be locked. In the mounted situation of the first grooves, the first grooves of the first guides correspond to each other, wherein the mutual distance between the partitions can be adjusted discretely in a simple manner.

The series of partitions is preferably arranged substantially transversely of the longitudinal direction of each of the pressure rollers, whereby the pressure rollers are supported over the whole extracting surface.

In the preferred embodiment of the device the first partition in the series of partitions is preferably arranged such that, when the pressure roller rolls over the blister pack, the pressure roller does not make contact with the first partition and forms a first side boundary for the blister pack.

In the preferred embodiment of the device according to the invention the device is further provided with a second side boundary for the blister pack which is arranged on the device such that, when each of the pressure rollers rolls over the blister pack, the second side boundary is pressed aside by the relevant pressure roller.

In order to automate the device, the device is provided with an automatic feed and discharge of blister packs.

The device is preferably provided with a removable cassette in which the series of partitions, the at least two parallel first guides and the second side boundary are arranged. The device is preferably provided with a plurality of cassettes, each adapted to a different type of blister pack. It is hereby possible to make the device quickly suitable for a different type of blister pack by simply exchanging the cassette.

In order to secure the setting of a cassette for a determined type of blister pack, the cassette is preferably provided with first locking means which are configured for co-action with placed partitions and the second side boundary and are intended for the purpose of locking the partitions and the second side boundary in the cassette. This prevents the setting of the partitions and the second side boundary becoming inaccurate.

In order to facilitate adjustment of the cassette, the device comprises a separate template in which a cassette taken out of the device can be received and wherein the template comprises two bearing surfaces mounted on either side of the template and intended for placing and adjustment of the partitions and the second side boundary in the first guides, wherein each bearing surface is provided with a first edge such that, following placing of the cassette in the template, the first edge lies in line with the first side boundary and each bearing surface is provided with a second edge which during operation lies at right angles to the partitions, and which second edge is provided with a series of second grooves lying in line with the series of first grooves.

In order to secure the cassette in the device, the device is provided with second locking means configured for co-action with the cassette and intended for the purpose of locking the cassette in the device.

In order to improve pressing-out of the pills from the blister pack, at least one pressure roller is removable from the device and provided with one or more pressure rings which are each arranged round a periphery of a pressure roller and wherein the position of each pressure ring is such that during operation of the device the pressure ring makes contact with an upper side of the blister pack under which at least one pill is located.

The device also relates to a method for adjusting a cassette for a determined type of blister pack in the above described device. For this purpose the method according to the invention comprises the following steps of:

a) placing the cassette in the template;
b) placing a blister pack of the determined type on each of the bearing surfaces;
c) placing an elongate aligning member along a first series of pills in each of the blister packs, wherein the aligning member is placed in corresponding first grooves of the parallel first guides;
d) placing a partition in corresponding first grooves of the parallel first guides along the aligning member;
e) repeating steps c) and d) for each following series of pills;
f) placing a blister pack of the determined type on the partitions such that a first side of the blister pack lies against the first side boundary;
g) placing the second side boundary in corresponding first grooves of the parallel first guides such that a second side of the blister pack remote from the first side lies against the second side boundary;
h) locking the placed partitions and the second side boundary to the cassette using the first locking means;
i) removing the cassette from the template.

The invention will be discussed in more detail hereinbelow with reference to the following figures, in which.

Similar components are designated in the figure with the same numerals.

Figure 1:
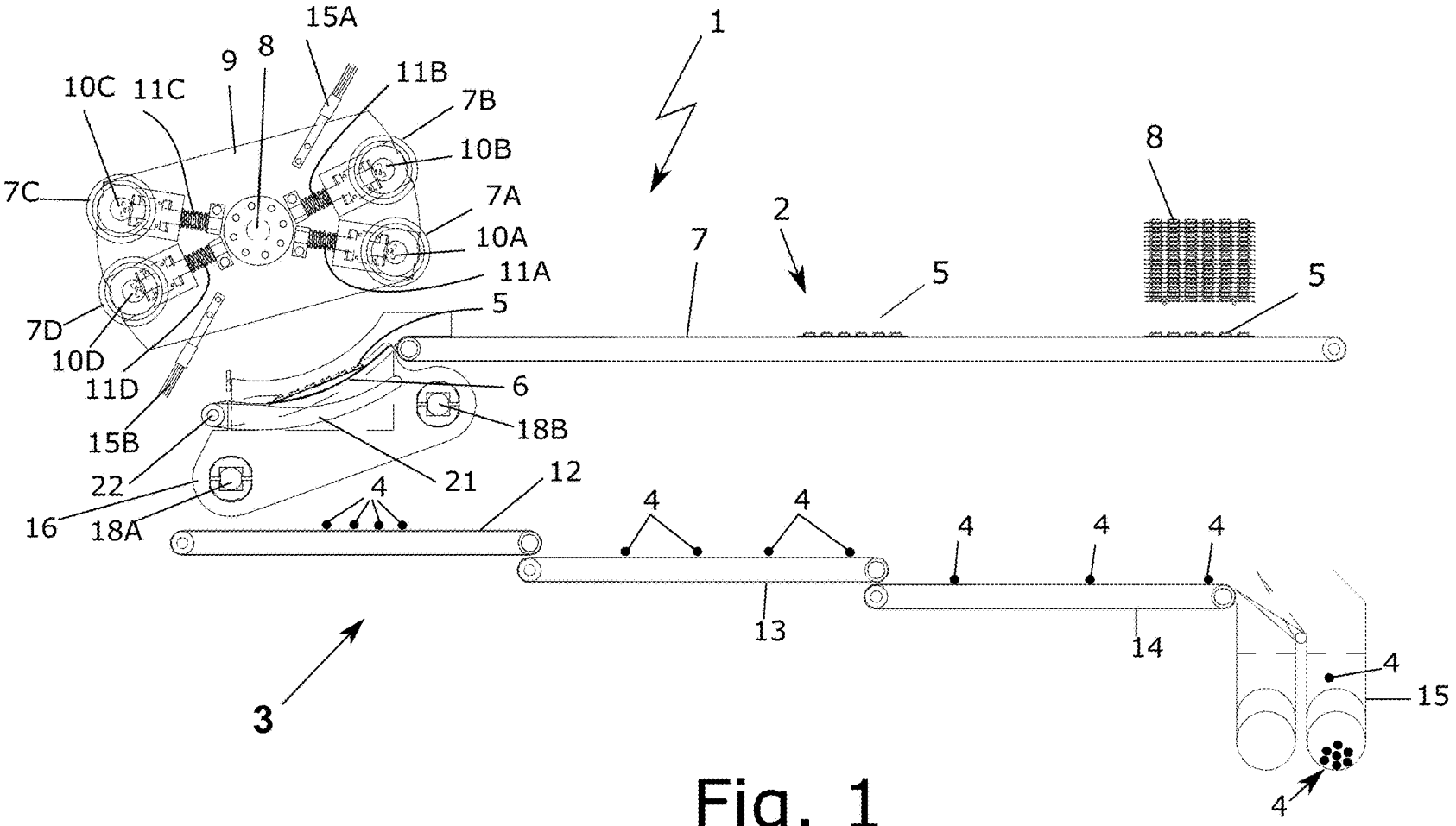
FIG. 1 is a schematic cross-sectional view of the preferred embodiment of the device according to the invention provided with automatic blister pack feed means and an automatic discharge for empty blister packs and pills.

FIG. 1 shows a cross-sectional view of the preferred embodiment of device 1 according to the invention provided with automatic blister pack feed means 2 and an automatic discharge 3 for pills. The automatic blister pack feed means 2 comprise a conveyor belt 7 and a blister pack supply holder 8. The automatic blister pack feed means 2 are configured such that a blister pack 5 is deposited from blister pack supply holder 8 onto conveyor belt 7, after which conveyor belt 7 transports blister pack 5 further.

Deblistering machine 1 is provided with an at least partially curved extracting surface 6 which takes a concave form and onto which the blister pack 5 is deposited by the automatic blister pack feed means 2. The push-through foil lies here against extracting surface 6. Extracting surface 6 is provided on the underside thereof with drop openings corresponding to positions of pills 4 in blister pack 5. The drop openings are more readily visible in the other figures.

Deblistering machine 1 also comprises four rotatable pressure rollers 7A, 7B, 7C, 7D which are preferably each provided with a rubber layer. Pressure rollers 7A, 7B, 7C, 7D are arranged rotatably around a rotation shaft 8, this rotation shaft lying perpendicularly of the plane of FIG. 1. The longitudinal direction of each pressure roller 7A, 7B, 7C, 7D runs parallel here to rotation shaft 8 and also lies perpendicularly of the plane of FIG. 1. It is important that rotation shaft 8 is arranged above extracting surface 6. Pressure rollers 7A, 7B, 7C, 7D are disposed in pairs such that during operation each pair of pressure rollers 7A, 7B; 7C, 7D rolls over one blister pack.

Pressure rollers 7A, 7B, 7C, 7D are each mounted on a rotating plate 9 which is arranged rotatably about rotation shaft 8. Each of the pressure rollers 7A, 7B, 7C, 7D can rotate here about its own pressure roller shaft 10A, 10B, 10C and 10D. The rolling pressure at which each pressure roller 7A, 7B, 7C, 7D is rollable during operation over at least a part of the surface of blister pack 5 is adjustable by means of spring device 11A, 11B, 11C, 11D.

The pills 4 pressed out of blister pack 5 drop through the drop openings into collecting means 12. Collecting means 12 can be a container, but also a conveyor belt. Collecting means 12 is shown in FIG. 1 as a conveyor belt which transports the pills further to a conveyor belt 13 and conveyor belt 14. Because conveyor belt 13 has a higher rotational speed than conveyor belt 12 and conveyor belt 14 has a higher rotational speed than conveyor belt 13, the pills 4 are singulated. Device 1 can hereby be provided with a counting mechanism which counts the pills at the end of conveyor belt 14 before pills 4 drop into a container 15.

Extracting surface 6 takes a partially cylindrical form, wherein rotation shaft 8 coincides with the axis of the cylindrically formed portion of extracting surface 6. Pressure rollers 7A, 7B, 7C, 7D can hereby roll better over extracting surface 6.

Each pair of pressure rollers 7A, 7B; 7C, 7D is provided with sweeping means 15A, 15B which are arranged fixedly on rotating plate 9. Sweeping means 15A, 15B are hereby rotatable around rotation shaft 8, whereby during operation of device 1 the sweeping means 15A, 15B sweep over at least a part of extracting surface 6. The sweeping takes place after the pills have been pressed out of a placed blister pack by one of the pairs of pressure rollers 7A, 7B; 7C, 7D, whereby blister pack 5 is swept off extracting surface 6.

Device 1 operates with the following automated steps:

a) A blister pack 5 is deposited from blister pack supply holder 8 onto conveyor belt 7.

b) The conveyor belt transports the blister pack to extracting surface 6 and deposits the blister pack 5 thereon. Pressure rollers 7A, 7B, 7C, 7D are in a position here such that they do not form an obstruction to blister pack 5.

c) Rotating plate 9 is rotated such that one of the pressure roller pairs 7A, 7B; 7C, 7D rolls over the blister pack 5 lying on extracting surface 6.

d) Rotating plate 9 is then rotated such that one of the sweeping means 15A, 15B sweeps blister pack 5 off extracting surface 6.

e) The pills pressed out of blister pack 5 drop through drop openings 17 onto conveyor belt 12, after which the pills are singulated on the further conveyor belts 13 and 14. The pills then drop into container 15.

f) Step a) is then performed again.

Figure 2:
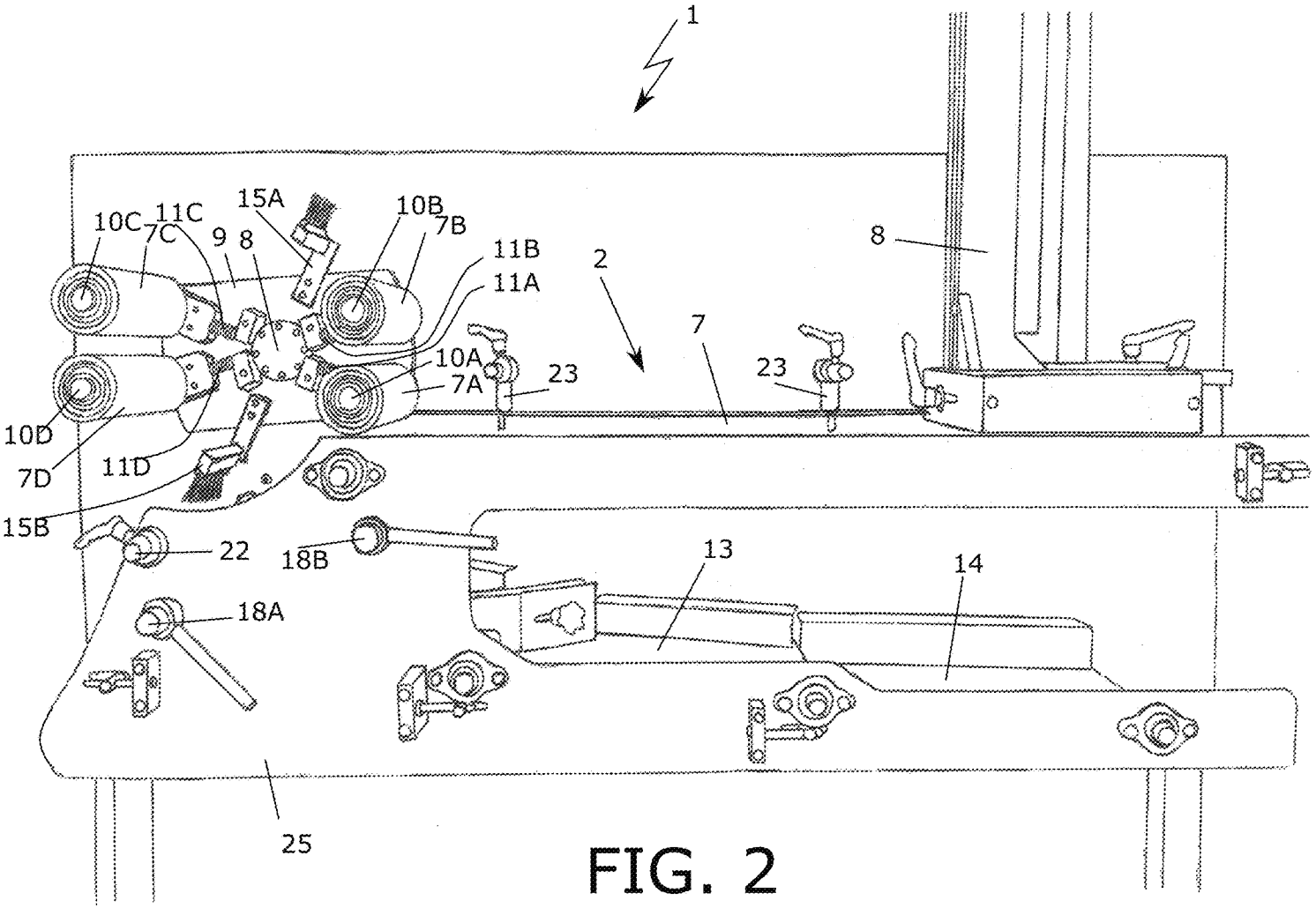
FIG. 2 is a 3-D side view of the preferred embodiment of the device according to the invention of FIG. 1.

FIG. 2 is a 3-D side view of the preferred embodiment of device 1 according to the invention of FIG. 1. Extracting surface 6 and conveyor belts 7, 12, 13, 14 are (partially) guarded by side plate 25. The outer ends of first guides 18A, 18B and second guide 22 are arranged in side plate 25.

Arranged on conveyor belt 7 is a guide 25 which can be adjusted with guide adjusting means 23. Guide 25 forms a side boundary for blister packs 5 so that blister packs 5 can be transported parallel to conveyor belt 7 to extracting surface 6.

Figure 3:
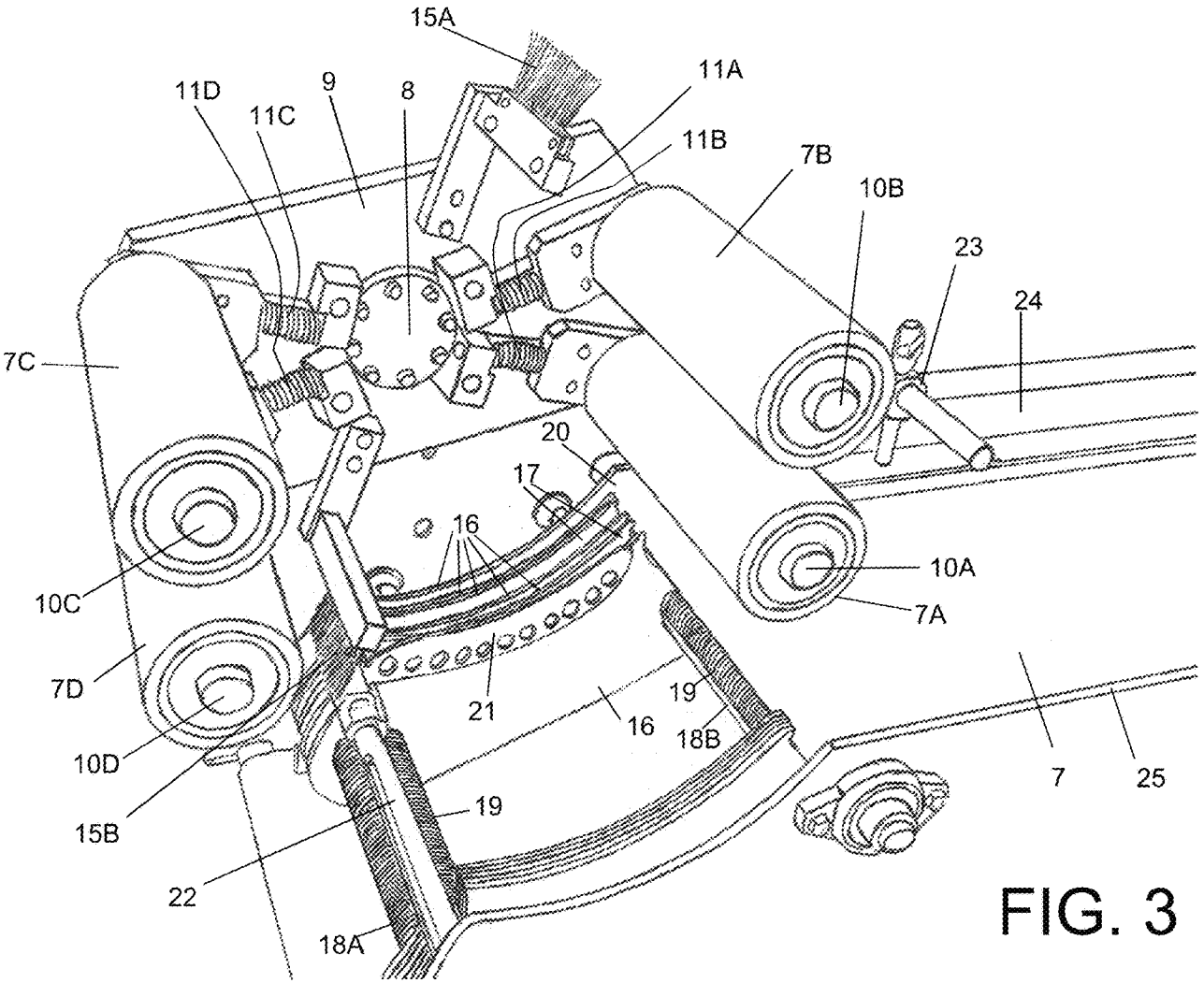
FIG. 3 is a 3-D top view of the preferred embodiment of the device according to the invention close to the pressure rollers.

FIG. 3 is a 3-D top view of the preferred embodiment of the device according to the invention close to pressure rollers 7A, 7B, 7C, 7D and gives a better view of how pressure rollers 7A, 7B, 7C, 7D roll over extracting surface 6.

Device 1 is provided with a series of substantially flat partitions 16 which run parallel, wherein at least a portion of an upper side thereof forms the extracting surface 6. The mutual distance between partitions 6 is adjustable, wherein the drop openings 17 are formed by one or more spaces between partitions 16. Partitions 16 are supported by means of two first guides 18A, 18B which run parallel and which each lie substantially transversely of partitions 16. Both first guides 18A, 18B are provided with corresponding first grooves 19, wherein each first groove is at least as wide as the thickness of each of the partitions 16. The mutual distance between the partitions can hereby be changed in simple manner by placing each of the partitions in the correct first grooves 19 of first guides 18A, 18B. This is necessary for instance in the case of a different type of blister pack in which the pills are at a different location. Owing to the position of guides 18A, 18B the pills 4 pressed out of blister pack 5 can drop without interruption via drop openings 17 onto conveyor belt 12 without making contact with further components of device 1.

When one of the pressure rollers 7A, 7B, 7C, 7D rolls over blister pack 5, the first partition in the series of partitions 16 does not make contact with pressure rollers 7A, 7B, 7C, 7D and lies slightly higher than the other partitions 16. The first partition hereby forms a first side boundary 20 for blister pack 5.

Device 1 is further provided with a second side boundary 21 for blister pack 5. Side boundary 21 is arranged displaceably and rotatably on one side thereof on a second guide 22 such that, when one of the pressure rollers 7A, 7B, 7C, 7D rolls over blister pack 5, the second side boundary 21 is pressed aside by the relevant pressure roller 7A, 7B, 7C, 7D. Side boundary 21 is provided for this purpose with a resilient mechanism 22, such as a torsion spring, which ensures that side boundary 21 re-places itself after one of the pairs of pressure rollers 7A, 7B; 7C, 7D has rolled over the extracting surface.

Figure 4:
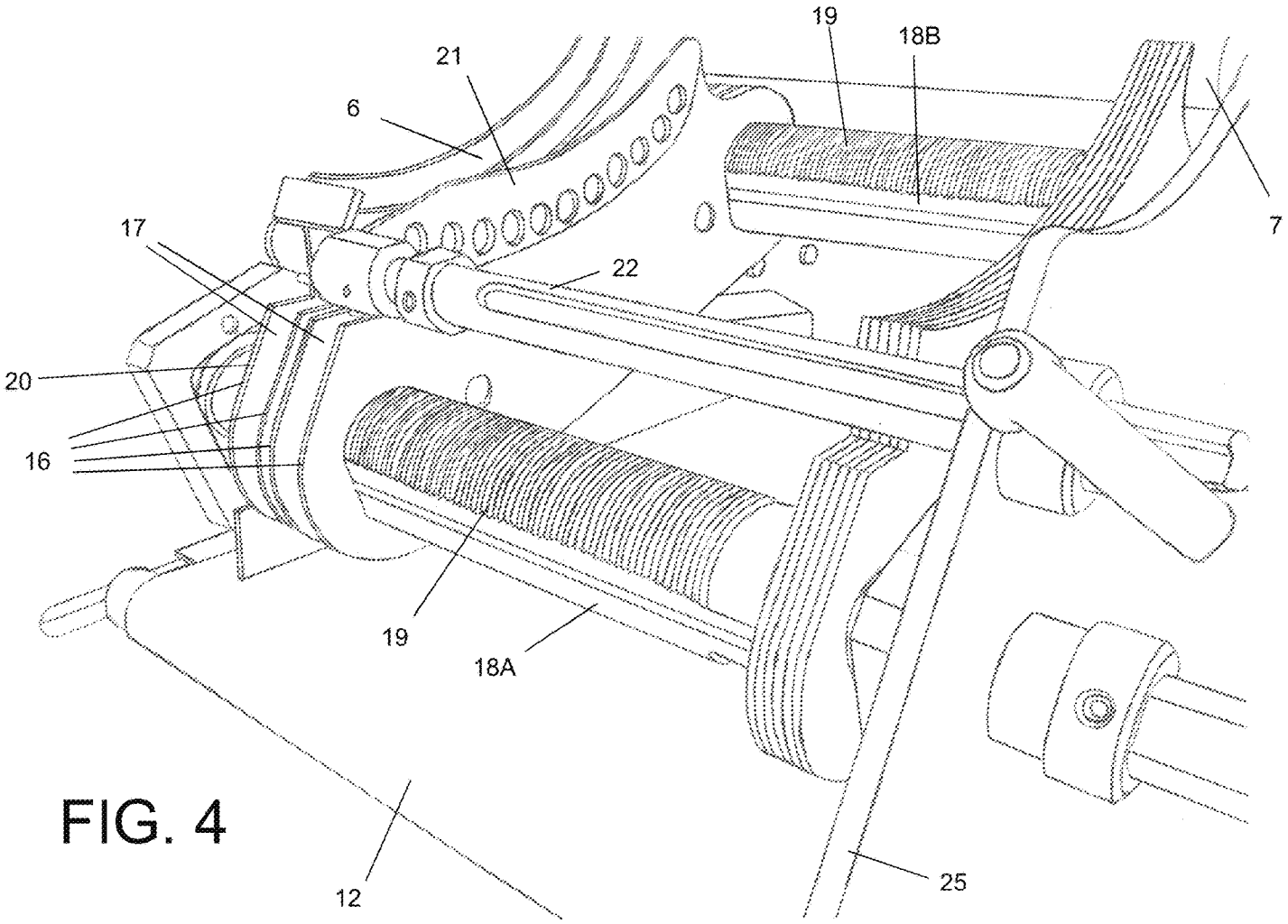
FIG. 4 is a 3-D side view of the preferred embodiment of the device according to the invention close to the pressure rollers.

FIG. 4 is a 3-D side view of the preferred embodiment of device 1 according to the invention close to pressure rollers 7A, 7B, 7C, 7D wherein the assembly of partitions 16 in device 1 is made apparent.

Figure 5:
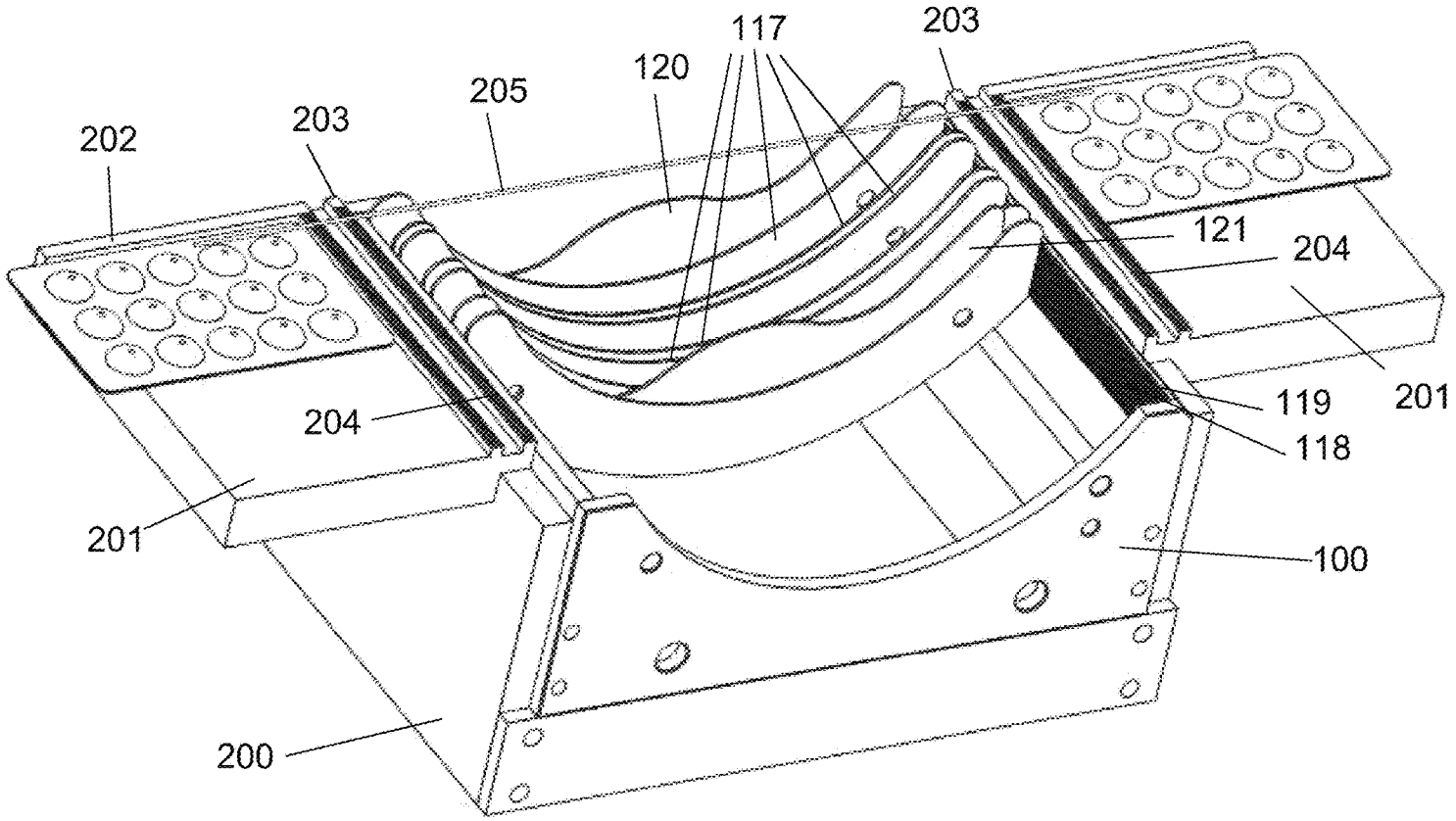
FIG. 5 shows a removable cassette for use in the device according to the invention.

FIG. 5 shows a removable cassette 100 for use in the device according to the invention. Removable cassette 100 is box-like and can be received in the device according to the invention. Cassette 100 comprises a series of partitions 117, a series of first grooves 119 (only one side visible) and at least two first guides 118 (only one side visible) which run parallel and are each provided with a series of first grooves 119 (only one side visible) and a first 120 and second side boundary 121. The operation and function of partitions 117, grooves 119, first guides 118 and first 120 and second side boundary 121 are the same as those of partitions 17, grooves 19, first guides 20 and first 20 and second side boundary 21 of the previous figures. The cassette is provided with first locking means which are configured for co-action with placed partitions 117 and the second side boundary 121 and which are intended for the purpose of locking the partitions 117 and the second side boundary 121 in cassette 100. For the purpose of adjusting the cassette 100 for a determined type of blister pack, the cassette 100 can be placed and received in a separate template 200. Template 200 comprises two bearing surfaces 201 mounted on either side of template 200 and intended for the purpose of placing and adjusting the partitions 117 and second side boundary 121 in first guides 118. Each bearing surface 201 is provided for this purpose with a first edge 202 which, after placing of cassette 100 in template 200, lies in line with first side boundary 120. Each bearing surface 201 is also provided with a second edge 203 which lies at right angles to partitions 117. Second edge 203 is provided with a series of second grooves 204 which lie in line with the series of first grooves 119 on first guides 118.

The method for adjusting a cassette 100 for a determined type of blister pack comprises the following steps of:

a) placing cassette 100 in template 200. In order to facilitate placing of cassette 100 in template 200, pins are preferably arranged on the template which correspond to holes in cassette 100;

b) placing a blister pack of the determined type on each of the bearing surfaces 201;

c) placing an elongate aligning member 205 along a first series of pills in each of the blister packs, wherein the aligning member is placed in corresponding second grooves of the parallel second edge;

d) placing a partition 117 in corresponding first grooves of the parallel first guides 118 along aligning member 205;

e) repeating steps c) and d) for each following series of pills;

f) placing a blister pack of the determined type on the partitions 117 placed in step d) such that a first long side of the blister pack lies against first side boundary 120;

g) placing second side boundary 121 into corresponding first grooves 119 of the parallel first guides 118 such that a second long side of the blister pack lies against second side boundary 121;

h) locking the placed partitions and the second side boundary to the cassette using the first locking means;

i) taking cassette 100 out of template 200.

Figure 6:
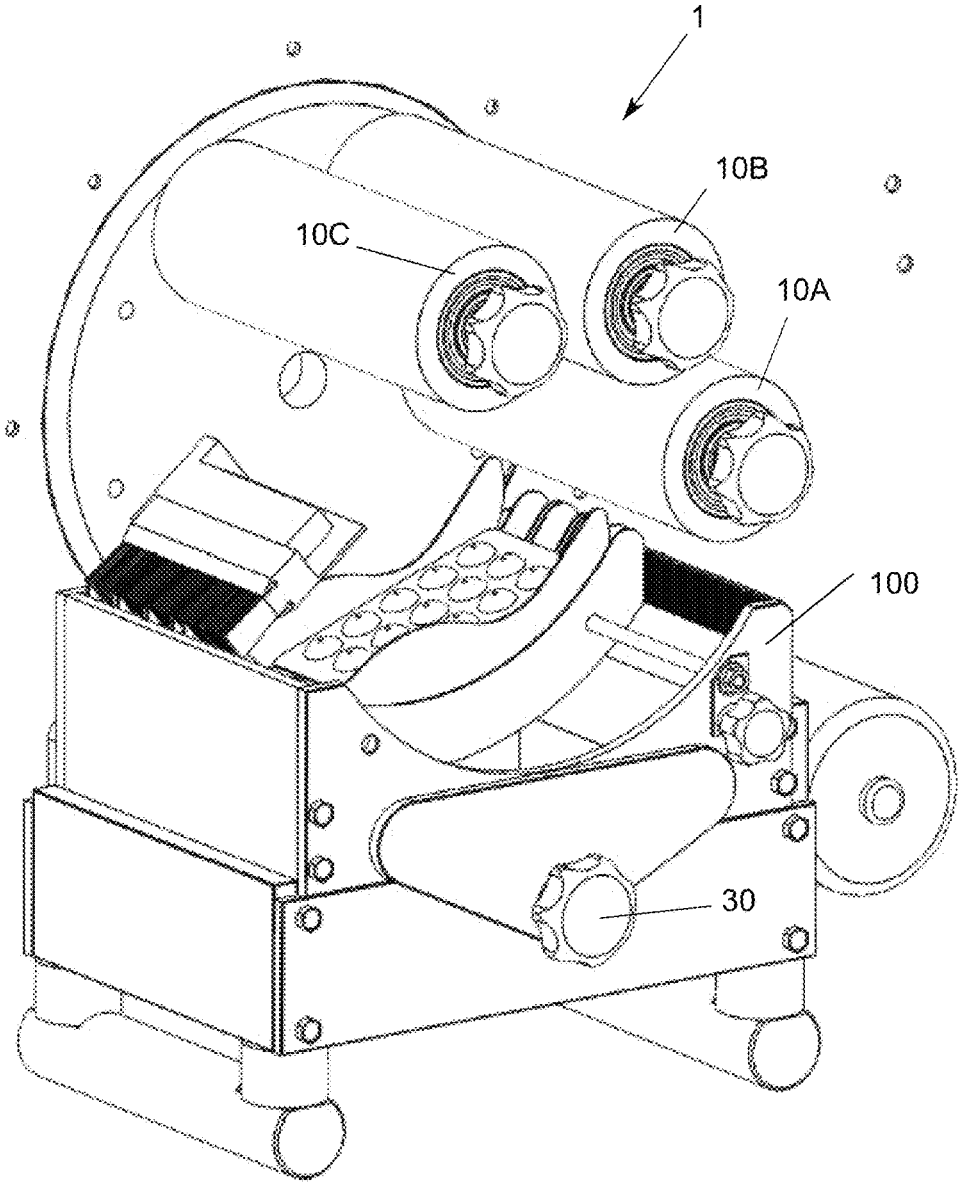
FIG. 6 shows a cassette placed in the device according to the invention.

FIG. 6 shows a cassette 100 placed in device 1 according to the invention, wherein parts of device 1 have been omitted for the sake of clarity. Once cassette 100 has been set for a determined type of blister pack using the template according to FIG. 5, cassette 100 is placed in device 1 under pressure rollers 10A, 10B, 10C. In the previous figures device 1 is embodied with four pressure rollers 10A, 10B, 10C, 10D. Later tests have shown that three pressure rollers are sufficient in the configuration of FIG. 6. Spring device 11A, 11B, 11C, 11D of FIG. 1 can be omitted here, provided use is made of flexible pressure rings which are each arranged round a periphery of at least one pressure roller and wherein the position of each pressure ring is such that during operation of device 1 the pressure ring makes contact with a blister pack adjacently of a series of pills of the blister pack. It is essential here that the relevant pressure roller is removable from the device.

Device 1 is provided with second locking means 30 which are configured for co-action with cassette 100 and intended for the purpose of locking the cassette 100 in device 1.

Figure 7:
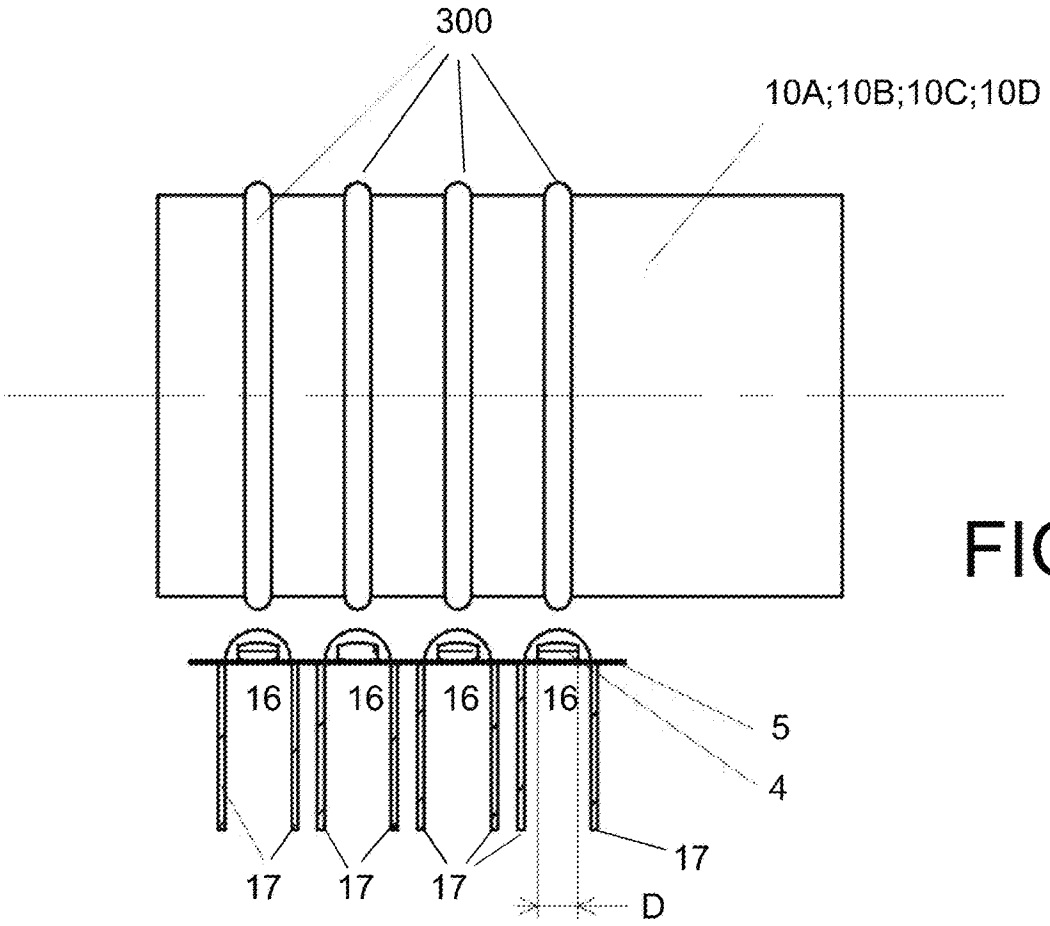
FIG. 7 shows the flexible pressure rings arranged on at least one pressure roller.

FIG. 7 shows the flexible pressure rings 300 which are arranged on at least one pressure roller 10A, 10B, 10C or 10D. Pressure rings 300 are each arranged round a periphery of a pressure roller. The position of each pressure ring 300 on pressure roller 10A, 10B, 10C or 10D is such that during operation of device 1 pressure ring 300 makes contact with an upper side of blister pack 5 under which at least one pill 4 is located. The number of pressure rings 300 is determined by the number of series of pills 4 on blister pack 5. The position of each pressure ring 300 preferably lies in the area D for each series of pills 4. The thickness and height of each pressure ring 300 is preferably adapted to the type of pill 4.

The invention is of course not limited to the described and shown preferred embodiment but extends to any embodiment falling within the scope of protection as defined in the claims and as seen in the light of the foregoing description and accompanying drawings.

The invention claimed is:

1. Device for extracting pills from a blister pack provided with a push-through foil, comprising:

an at least partially curved extracting surface for stationary placing of the blister pack, wherein the push-through foil lies against the extracting surface and wherein the extracting surface is provided on the underside with drop openings corresponding to positions of the pills in the blister pack, one or more rotatable pressure rollers, wherein each pressure roller is rollable with predetermined rolling pressure over at least a part of the surface of the blister pack during operation for the purpose of pressing the pills out of the blister pack through the push-through foil and through the drop openings, and a collecting means placed under the extracting surface for collecting pills which have dropped through the drop openings, wherein the at least partially curved extracting surface takes a concave form, wherein the device is further provided with a series of substantially flat partitions which run parallel, wherein at least a portion of an upper side thereof forms the extracting surface, wherein the mutual distance between the partitions is adjustable, the drop openings are formed by one or more spaces between the partitions and the partitions are arranged such that the pills pressed through the blister pack can drop without interruption via the drop openings into the collecting means, wherein the device is further provided with at least two first guides which run parallel to each other and which each lie substantially transversely of the partitions and which are intended for the purpose of supporting the partitions and adjusting the mutual distance between the partitions.

2. Device as claimed in claim 1, wherein the one or more pressure rollers are arranged for rotation around a rotation shaft, wherein the longitudinal direction of each pressure roller runs parallel to the rotation shaft and the rotation shaft is arranged substantially above the extracting surface.

3. Device as claimed in claim 2, wherein the extracting surface takes an at least partially cylindrical form and wherein the rotation shaft coincides with the axis of the cylindrically formed part of the extracting surface.

4. Device as claimed in claim 1, wherein the rolling pressure of at least one pressure roller is adjustable.

5. Device as claimed in claim 1, wherein the pressure rollers are disposed in pairs such that during operation each pair of pressure rollers rolls over a blister pack.

6. Device as claimed claim 1, wherein the device is provided with one or more sweeping means which are each arranged rotatably around the rotation shaft such that during operation one of the sweeping means sweeps over at least a part of the extracting surface after the pills have been pressed out of a placed blister pack by the one or more pressure rollers.

7. Device as claimed in claim 1, wherein the extracting surface is provided with a stop member for holding the blister pack in position during rolling of one of the pressure rollers over the blister pack during operation.

8. Device as claimed in claim 1, wherein the device is provided with one or more brushes and means for rotating the brushes, wherein the one or more brushes are arranged rotatably around the rotation shaft and the longitudinal direction of each brush runs parallel to the rotation shaft and wherein the brushes brush over at least a part of the blister pack during operation.

9. Device as claimed in claim 1, wherein each guide is provided with a series of first grooves intended for the purpose of adjusting the mutual distance between the partitions.

10. Device as claimed in claim 1, wherein the series of partitions is arranged substantially transversely of the longitudinal direction of each of the pressure rollers.

11. Device as claimed in claim 1, wherein the first partition in the series of partitions is arranged such that, when the pressure roller rolls over the blister pack, the pressure roller does not make contact with the first partition and forms a first side boundary for the blister pack.

12. Device as claimed in claim 11, wherein the device is further provided with a second side boundary for the blister pack which is arranged on the device such that, when one of the pressure rollers rolls over the blister pack, the second side boundary is pressed aside by the relevant pressure roller.

13. Device as claimed in claim 1, wherein the device is provided with automatic blister pack feed and discharge means.

14. Device as claimed in claim 1, wherein the device is provided with a removable cassette in which the series of partitions, the series of first grooves and the at least two parallel first guides and the second side boundary are arranged.

15. Device as claimed in claim 14, wherein the cassette is provided with first locking means which are configured for co-action with placed partitions and the second side boundary and are intended for the purpose of locking the partitions and the second side boundary in the cassette.

16. Device as claimed in claim 15, wherein the device is provided with second locking means configured for co-action with the cassette and intended for the purpose of locking the cassette in the device.

17. Device as claimed in claim 14, comprising a separate template in which a cassette taken out of the device can be received and wherein the template comprises two bearing surfaces mounted on either side of the template and intended for placing and adjustment of the partitions and the second side boundary in the first guides, wherein each bearing surface is provided with a first edge such that, following placing of the cassette in the template, the first edge lies in line with the first side boundary, and each bearing surface is provided with a second edge which lies at right angles to the partitions, and which second edge is provided with a series of second grooves lying in line with the series of first grooves.

18. Device as claimed in claim 1, wherein at least one pressure roller is removable from the device and provided with one or more flexible pressure rings which are each arranged round a periphery of a pressure roller and wherein the position of each pressure ring on the pressure roller is such that during operation of the device the pressure ring makes contact with an upper side of the blister pack under which at least one pill is located.

19. Method for adjusting a cassette for a determined type of blister pack in a device for extracting pills from a blister pack provided with a push-through foil, comprising:

an at least partially curved extracting surface for stationary placing of the blister pack, wherein the push-through foil lies against the extracting surface and wherein the extracting surface is provided on the underside with drop openings corresponding to positions of the pills in the blister pack, one or more rotatable pressure rollers, wherein each pressure roller is rollable with predetermined rolling pressure over at least a part of the surface of the blister pack during operation for the purpose of pressing the pills out of the blister pack through the push-through foil and through the drop openings, and a collecting means placed under the extracting surface for collecting pills which have dropped through the drop openings, wherein the at least partially curved extracting surface takes a concave form, wherein the device is further provided with a series of substantially flat partitions which run parallel to each other, wherein at least a portion of an upper side thereof forms the extracting surface, wherein the mutual distance between the partitions is adjustable, the drop openings are formed by one or more spaces between the partitions and the partitions are arranged such that the pills pressed through the blister pack can drop without interruption via the drop openings into the collecting means, wherein the device is further provided with at least two first guides which run parallel to each other and which each lie substantially transversely of the partitions and which are intended for the purpose of supporting the partitions and adjusting the mutual distance between the partitions, comprising a separate template in which a cassette taken out of the device can be received and wherein the template comprises two bearing surfaces mounted on either side of the template and intended for placing and adjustment of the partitions and the second side boundary in the first guides, wherein each bearing surface is provided with a first edge such that, following placing of the cassette in the template, the first edge lies in line with the first side boundary, and each bearing surface is provided with a second edge which lies at right angles to the partitions, and which second edge is provided with a series of second grooves lying in line with the series of first grooves, wherein the device is provided with a removable cassette in which the series of partitions, wherein each guide is provided with a series of first grooves intended for the purpose of adjusting the mutual distance between the partitions, the series of first grooves and the at least two parallel first guides and the second side boundary are arranged, wherein the device is further provided with a series of substantially flat partitions which run parallel, wherein at least a portion of an upper side thereof forms the extracting surface, wherein the mutual distance between the partitions is adjustable, the drop openings are formed by one or more spaces between the partitions and the partitions are arranged such that the pills pressed through the blister pack can drop without interruption via the drop openings into the collecting means, wherein the method comprises the following steps of:

a) placing the cassette in the template;

b) placing a blister pack of the determined type on each of the bearing surfaces;

c) placing an elongate aligning member along a first series of pills in each of the blister packs, wherein the aligning member is placed in corresponding first grooves of the parallel first guides;

d) placing a partition in corresponding first grooves of the parallel first guides along the aligning member;

e) repeating steps c) and d) for each following series of pills;

f) placing a blister pack of the determined type on the partitions such that a first side of the blister pack lies against the first side boundary;

g) placing the second side boundary in corresponding first grooves of the parallel first guides such that a second side of the blister pack remote from the first side lies against the second side boundary;

h) locking the placed partitions and the second side boundary to the cassette using the first locking means;

i) removing the cassette from the template.

* * * * *